US006932128B2

(12) United States Patent
Turan, Jr.

(10) Patent No.: US 6,932,128 B2
(45) Date of Patent: Aug. 23, 2005

(54) APPARATUS AND METHOD FOR USING A LIGHTWEIGHT PORTABLE AIR/GAS POWER SUPPLY

(75) Inventor: Robert Lew Turan, Jr., North Lauderdale, FL (US)

(73) Assignee: Speed Air Systems, Inc., Oakland, FL (US)

( * ) Notice: Subject to any disclaimer, the term of this patent is extended or adjusted under 35 U.S.C. 154(b) by 427 days.

(21) Appl. No.: 10/186,086

(22) Filed: Jun. 28, 2002

(65) Prior Publication Data

US 2004/0000343 A1 Jan. 1, 2004

(51) Int. Cl.[7] ..... B65B 1/04

(52) U.S. Cl. ..... 141/389; 141/37; 141/94; 224/263; 224/627; 222/175

(58) Field of Search ..... 141/18, 37, 39, 141/51, 94, 389; 224/148.6, 263, 600, 627, 907, 148, 210, 211; 222/175; 417/379, 362, 363, 473; 128/205.22

(56) References Cited

U.S. PATENT DOCUMENTS

| | | | | |
|---|---|---|---|---|
| 3,872,934 A | | 3/1975 | Terada | |
| 4,662,551 A | * | 5/1987 | Dudley et al. | 224/633 |
| 4,838,034 A | * | 6/1989 | Leonard et al. | 62/50.2 |
| 5,020,712 A | | 6/1991 | Monacelli | |
| 5,036,845 A | | 8/1991 | Scholley | |
| 5,127,399 A | | 7/1992 | Scholley | |
| 5,134,776 A | | 8/1992 | Moody | |
| 5,243,761 A | | 9/1993 | Sullivan et al. | |
| 6,065,373 A | | 5/2000 | Watanabe et al. | |
| 6,149,356 A | | 11/2000 | Chu et al. | |
| 6,268,077 B1 | | 7/2001 | Kelley et al. | |
| 6,321,854 B1 | | 11/2001 | Bisutti | |
| 6,357,439 B1 | | 3/2002 | Cook et al. | |

* cited by examiner

*Primary Examiner*—Timothy L. Maust
(74) *Attorney, Agent, or Firm*—Hall, Myers, Vande Sande & Pequignot

(57) ABSTRACT

A lightweight carbon fiber air/gas supply vessel storing high pressure air/gas. The air/gas supply vessel output is controlled by an adjustable pressure reduction valve which varies output pressure from very high to low pressure levels. An alternative multi-valve system uses a first pressure reduction valve to reduce output pressure from the very high levels in the air/gas supply vessel to an intermediate pressure level, and a second pressure reduction valve that reduces the air/gas pressure from the intermediate level to a fine tunable low pressure level. In both embodiments, the output of the last pressure reduction valve used is connected to a high pressure cable which in turn uses a standard universal fitting which can be coupled to most pneumatically powered equipment. Additional high pressure reservoir vessels can be used to replenish the lightweight air/gas supply vessel when its supply of air/gas is depleted.

21 Claims, 6 Drawing Sheets

APPARATUS AND METHOD FOR USING A LIGHTWEIGHT PORTABLE AIR/GAS POWER SUPPLY

BACKGROUND OF THE INVENTION

1. Technical Field

The present invention relates to pneumatic power tool systems. In particular, it relates to a portable pneumatic power system which is lightweight, and has a refillable high-pressure air/gas canister which is refillable on the job site, and which provides adjustable high-pressure air/gas for use with pneumatic tools or other devices that are pneumatically powered.

2. Background Art

Originally, a wide variety of construction activities required repetitive action to complete their tasks. For example, building construction requires extensive nailing of the various components that comprise a structure. Furniture construction requires substantial, stapling, nailing, etc. Likewise, the number of commercial manufacturing, construction, maintenance, and other activities which require this type of repetitive manual activity is too large to list individually. A disadvantage associated with this type of activity is that it is tiring for the workmen who have to manually secure each nail, screw, etc., during the work process. In addition to the inconvenience experienced by the workmen due to the nature of the process in which workmen were required to manually control each operation, construction time was also extended, which in turn increased costs and reduced profits.

To avoid the disadvantages of manual construction techniques, the construction, carpentry, and other trades have developed a wide variety of power tools for use in a wide range of activities. Many activities, including building construction, automobile fabrication and maintenance, carpentry, etc, have benefitted from the use of specialized power tools which allow workmen to complete the task of nailing, screwing, etc., with a minimum amount of manual exertion, and with a minimum amount of time to complete the task. Examples of these tools would be: a pin tacker used for molding and cabinets and typically using 90 psi of air pressure; a micro pinner used for molding and typically using 60–70 psi of air pressure; a brad nailer used for molding and cabinet finish work and typically using 90 psi of air pressure; a roof coil nailer used for roofing and typically using 70–125 psi of air pressure; a framing nailer used for building frame construction and typically using 80–125 psi of air pressure; etc. The use of these power tools has permitted workmen to make substantial increases in productivity due to the speed and ease of use that these tools provide.

In addition to the problems associated with supplying air pressure to pneumatic power tools, numerous other devices use air pressure. For example, in the automobile maintenance and towing industries, repair of flat tires is relatively easy inside a garage where an air compressor is usually available. However, tire repair frequently takes place outside of a garage where there is no air compressor. It would be advantageous to have a compact, lightweight, portable air supply system for inflating vehicle tires in locations where a high pressure air supply was not normally available.

In addition to tools and vehicles, there are also other applications which would benefit from the availability of high pressure air. For example, recreational activities often involve the use of inflatable devices. For example, camper often use inflatable tents which can be difficult and time consuming to inflate. Likewise, inflatable beds and rafts are also commonly used and require substantial effort to inflate. It would be desirable to have an easy method of inflating recreational devices such as this.

While these tools have provided substantial benefits to both business and to the workmen who work for those businesses, there are several disadvantages associated with them. For example, a number of electrically hand-held power tools have been designed for use in a variety of trades. A disadvantage of this type of power tool is that there is a substantial additional weight in the tool due to the presence of an electric motor. In the case where the handheld power tool is battery-powered rather than connected to a power source via a wire, the tool will also have the substantial additional weight associated with the batteries. Even though these devices are faster than prior art manual construction techniques, due to the weight, size and space requirements caused by the electric motors and/or the batteries, these devices are heavier and have more bulk. This causes them to be more difficult to manipulate, and contributes to work fatigue due to their weight and increased difficulty in manipulating. It would be desirable to have a portable handheld power tool which did not have the weight and bulk disadvantages associated with prior art electrical power tools.

The weight and bulk disadvantages associated with batteries can be overcome by using a handheld power tool which plugs into a conventional wall power socket. However, there are disadvantages to this configuration as well. Of course, in the situation where there is no available power socket, as would be the case when framing is being installed during the process of construction, these tools would be unusable because they do not have access to available wall sockets. As a result, a portable generator would have to be available to provide power to operate the power tools. Portable generators tend to be expensive, heavy, and inconvenient to use. For example, during the course of a workday, the portable generator may have to be moved from place to place in order to be close enough to the ongoing work. This creates additional inconvenience, it wastes time and it increases costs during the construction process. It would be desirable to have portable power supply which is convenient to move to any location in a work site.

Another type of handheld power tool which has been developed is the category of tools which use pneumatic power. These tools can be used in a wide variety of applications such as nailing, stapling, screwing, drilling, and for use in devices such as handheld power wrenches for removing or installing nuts/bolts, etc. Typically these devices are attached to a pneumatic air hoses which provides air pressure to the tool. These pneumatic tools have a similar disadvantage to those encountered by electric handheld power tools. In particular, they typically use a large air compressor which may have to be moved to accommodate particular work activities. In addition, if the work is being performed in inconvenient locations, such as on the roof of a building under construction, it may be difficult if not impossible to provide an air compressor without running extended length air hoses.

In addition to the disadvantages associated with the compressors, if the compressor is a substantial distance from the power tool, then the weight and drag of the air hose creates a problem for the workman due to the extra work they create as the workman moves about. It would be advantageous to have a method of supplying pneumatic power to handheld tools which does not have the disadvantages associated with the use of prior art air compressors, and without the need for running air hoses from an air compressor to the pneumatic tool.

Another problem associated with power tools is that when air/gas compressors are used, those compressors can have a proprietary interface which prevents the power supply from being interchanged with a variety of tools. More important, since each power tool is designed to accomplish a unique task, each tool has a requirement for varying levels of air pressure in order to accomplish those tasks. As a result, a single high pressure vessel may be suitable for one tool, but it would not be capable of being used with a variety of pneumatic power tools which each require a different air/gas pressure level. It would be advantageous to have a single pneumatic power supply that could be interchangeably used with any number of pneumatic tools, and which would have a wide range of adjustable pressure settings to accommodate the unique requirements of each pneumatic power tool.

A further problem associated with pneumatic power tools is the availability of a sufficient supply of air/gas to power the tools. In prior art attempts to provide pneumatic power, typically a large powered pump system must be provided, with all of the inconvenience and expense associated with them. It would be advantageous to have a single small and portable supply of compressed air/gas which is easy to carry, and which can optionally be quickly refilled from an auxiliary supply vessel.

While addressing the basic desirability of providing power to tools for the purpose of increasing productivity, the prior art has failed to provide a power supply system for pneumatic tools which is very lightweight, very compact, whose output pressure can be adjusted such that the same power supply can be used with any number of pneumatic tools, and which can be quickly and conveniently refilled from an auxiliary supply vessel. Further, the prior art has failed to provide a pneumatic power supply which can adjust output air/gas pressure from very high pressure to very low pressure such that can accommodate a wide range of power tools which each require a unique air/gas pressure level.

SUMMARY OF THE INVENTION

The present invention solves the foregoing problems by providing a lightweight carbon fiber air/gas supply vessel which stores air/gas at very high pressure levels. The output of the air/gas supply vessel is controlled by a single pressure reduction valve which can adjustably vary output pressure from very high pressure levels to very low pressure levels. Alternatively, a multivalve pressure control system is used in which a first pressure reduction valve reduces the output pressure from the very high levels in the air/gas supply vessel to an intermediate level, and then a second pressure reduction valve is used to reduce the air/gas pressure from the intermediate level to a fine tunable low pressure level. In both embodiments, the output of the last pressure reduction valve used is connected to a high pressure air hose which in turn uses a standard universal fitting which can be coupled to most pneumatically powered equipment. Optionally, one or more high pressure reservoir vessels can be used to replenish the lightweight air/gas supply vessel when its supply of air/gas is depleted. The air/gas supply vessel has a direct quick connect adapter attachment which attaches to the output pressure valve. The quick connect adapter is also used to attached a refill line to the air/gas supply vessel. This provides the user with the convenience of carrying a small lightweight air/gas supply vessel which can be easily and quickly refilled when needed.

DESCRIPTION OF THE PREFERRED EMBODIMENT

Figure 1:
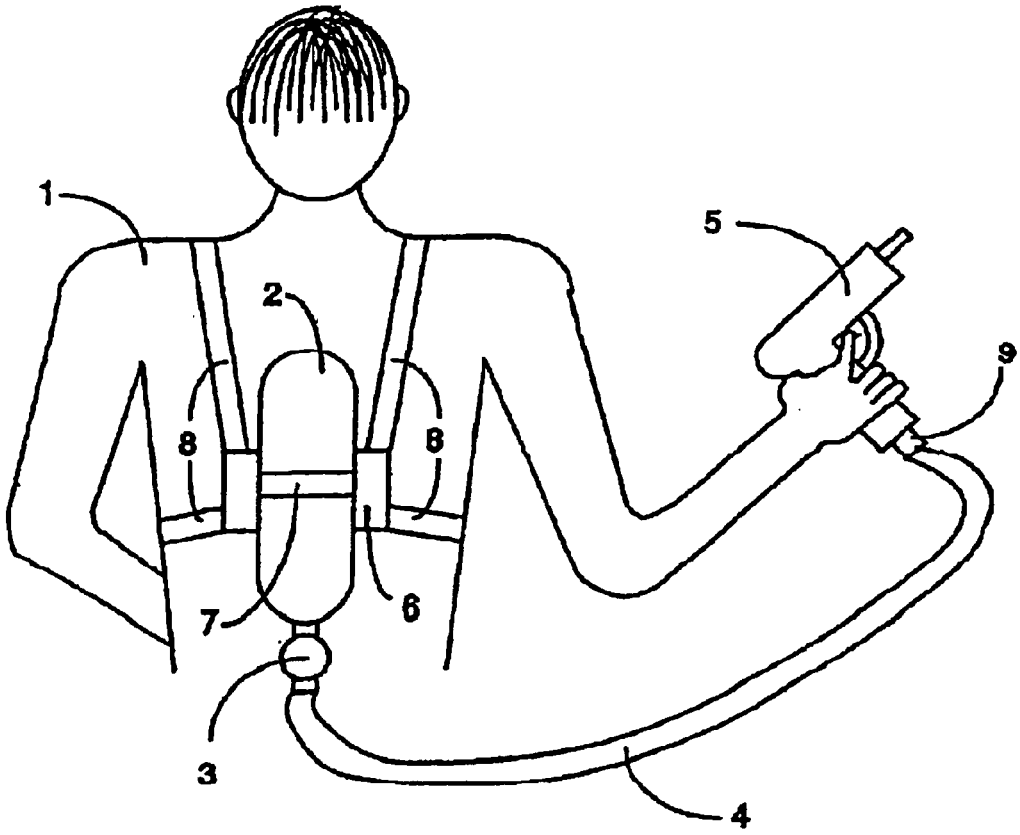
FIG. 1 illustrates a preferred embodiment of the pneumatic air supply system suspended from a workman's back with a single wide range pressure regulation valve which feeds the high pressure cable attached to a fitting on a handheld power tool.

Prior to a detailed description of the figures, a general overview of the invention will be presented. The invention provides a very lightweight compact pneumatic air/gas power supply which can be conveniently carried by a workman during the course of a workday. The air/gas power supply is designed to carry a sufficient amount of air/gas to power a variety of power tools or other equipment for a substantial period of time, while at the same time having a low enough weight and a small enough form factor such that it does not interfere with a workman's activity. The air/gas power supply system is intended to be entirely portable such that the workman can carry it throughout a work site with minimal effort.

An important feature of the invention is a high pressure air/gas storage vessel which, due to its high pressure capacity, can store a substantial amount of pressurized air/gas within a small vessel. For convenience, the term "air/gas" is used throughout the specification to denote the fact that any suitable gas (for example, carbon dioxide, nitrogen, air, etc.) can be used. However, those skilled in the art will recognize that ordinary air is the least expensive and best type of gas for most applications. In the preferred embodiment, it has been found that carbon fiber vessels provide suitable strength to safely store compressed air/gas at pressures up to approximately 6,000 psi. Carbon fiber vessels also provide an additional advantage in that they are relatively lightweight, which adds to the workman's convenience. Carbon fiber vessels are known and are commercially available. In addition to carbon fiber vessels, any suitable vessel made from any suitable material can be used so long as it provides sufficient capacity and high pressure capability.

The air/gas stored at high pressures within the air/gas storage vessel is used with conventional pneumatic handheld power tools or other similar devices. Typically, these types of tools and devices require relatively low air pressure, often less than 125 psi. As a result, direct input of the air/gas at the high pressure in the air/gas storage vessel would very possibly cause the power tool or device to malfunction and may in fact damage it. Attached to the output of the air/gas storage vessel is an adjustable wide range pressure valve which allows the workman to set the output pressure to the correct pressure rating for the particular tool being used.

In the preferred embodiment, the air/gas is fed from the air/gas supply vessel through the pressure regulator valve and then through an air hose to a standard universal attachment couple. Universal attachment couples are known in the art and are typically designed so that they can be quickly attached to a mating couple on the power tool or other device. For example, the preferred couple for most application of the invention would be a commercially available standard 0.25 inch male/female quick disconnect. Since the air/gas supply system is designed to be used with any type of pneumatic tool, the adjustable pressure regulator valve attached to the air/gas vessel is used to adjust the output pressure such that the workman can easily set the correct pressure for any particular tool that the workman is using at that time. As a result, it is no longer necessary to have separate power supplies for individual tools, or to use an air/gas supply with a single pressure output. The use of multiple power supplies increases cost and it's inconvenient. Likewise, the use of a single air/gas supply with a fixed pressure output can affect the performance of the tools or devices being used. The wide range pressure reduction valve used by the invention allows the workman to fine tune a low output pressure level when using the high pressure air/gas supply system. By adjusting the air pressure to suit a particular tool, that tool will be able to work at its optimal performance level.

In the preferred embodiment, the air/gas supply vessel is attached to the workman's tool belt. This benefits the worker by placing the air/gas supply vessel where it can be easily supported and conveniently carried. In addition, none of the weight from the air/gas supply vessel is borne by the power tool. This means that the power tool is lighter and easier to hold and manipulate. Likewise, by separating the air/gas supply from the power tool, it is not necessary for the power tool to hold a reservoir of air/gas. As a result, the power tool can be constructed such that it is smaller, lighter, and easier to manipulate. This configuration allows a workman to conveniently use pneumatic power tools in inconvenient places, such as the roof of a building under construction. In addition, due to its small size and weight, it allows a workman to accomplish a given task with a minimum amount of fatigue.

It has been found that a small high pressure air/gas supply vessel is often sufficient to supply a workman's tools with power for an entire workday, depending on the nature of the work. For example, for a power tool driving small objects, such as pins or brads, the air/gas supply vessel should be adequate for the entire work day. When more powerful tools are used, such as those used for larger nails used in roofing work, the air/gas supply vessel may have to be refilled. However, an alternative embodiment which uses a reservoir tank allows the air/gas supply vessel to be quickly refilled at the job site. In this alternative embodiment, a reservoir tank which holds a substantial supply of high pressure air/gas is used to refill the air/gas supply vessel. A preferred alternative embodiment uses a large air/gas reservoir tank, which may be a larger carbon fiber vessel, or any other suitable vessel. For example, even an air tank such as one used for scuba diving can be used to provide a supply of high pressure air/gas. In the preferred embodiment, the air/gas supply vessel would weigh approximately 2 pounds which is light and convenient for the workman to carry. The larger reservoir tank may weigh as much as 46 pounds. However, those skilled in the art will recognize that these weights can vary based on design choices and fabrication materials.

When the supply of air/gas in the air/gas supply vessel is depleted, an air hose from the reservoir tank is attached to the input connector on the air/gas supply vessel. The reservoir tank valve is then opened to allow the air/gas supply vessel to be refilled. Due to its much larger size in relation to the air/gas supply vessel, the reservoir tank can refill the air/gas supply vessel numerous times. As a result, even though the air/gas supply vessel is relatively small and lightweight, if the workman uses a reservoir tank then the workman can be confident that more than an adequate supply of compressed air/gas is available for a days work. The reservoir tank can typically be conveniently stored in the back of the workman's truck, or even in the trunk of the workman's automobile. Of course, the reservoir tank can be shared by multiple workmen such that only one reservoir tank provides suitable refill capacity for an entire work crew.

An alternative preferred embodiment provides for an air/gas storage vessel which has multiple pressure regulator valves. In this embodiment, air/gas which is held in the air/gas storage vessel under high pressure (for example: 6,000–3,000 psi) is outputted to a first high pressure regulator valve which may or may not have a fixed output pressure. The first high pressure valve will output air/gas storage vessel at some intermediate value (for example, 4,500–800 psi). This reduced pressure air/gas is then input to a second adjustable pressure valve which is capable of adjustably outputting air/gas at low pressures, on the order of 125 psi or less. The advantage of multiple valves is that they may be less expensive than a single valve capable of regulating pressure over a wide range (i.e., 6,000 psi to 125 psi or less).

As a result of the invention, a workman is able to carry a universal air/gas supply which can be attached to most pneumatic tools via a universal connector. The air/gas supply vessel used by the invention carries a substantial amount of compressed air/gas due to the high pressure which the air/gas supply vessel is capable of safely sustaining. Further, an air/gas supply vessel fabricated from lightweight materials such as carbon fiber is very lightweight and convenient to carry. In addition, by attaching the air/gas supply vessel to a workman's tool belt, the workman can carry the air/gas supply system conveniently, without interfering with a workman's movement, and without adding any weight to the power tool. The use of a backup reservoir tank ensures that the workman has an adequate supply of air/gas even though the air/gas supply vessel is relatively small. Optional regulation methods allow the use of a single precise and adjustable high pressure regulator valve, or alternatively, multiple regulator valves which reduce the air pressure from the air/gas supply vessel in steps which allow less expensive components to be used.

In addition to supplying air pressure to pneumatic power tools, the air/gas supply vessel can be used for numerous other devices. Regarding automobiles, when a vehicle breaks down due to a flat tire, it usually in an inconvenient location. When a tow truck arrives, it may have a large, expensive compressor on board, but it may also have no method of reinflating a flat tire. The towing industry can effectively use the invention as a portable system for reinflating tires when necessary. The system is small and inexpensive, which allows its use on all types of vehicles. It allows repair of flat tires to be easily accomplished at the site of the breakdown which may eliminate the need for towing and its related expense. By carrying the air/gas supply system on board, the auto repairman can make repairs to tires anywhere, which helps the automobile owner resume their trip more rapidly and economically.

A variety of other applications also benefit from the availability of high pressure air. Recreational activities often involve the use of inflatable devices such as inflatable tents. Tents are difficult and time consuming to inflate. The inexpensive high pressure air/gas supply system provided herein allows campers to easily inflate tentsin a minimum amount of time. Inflatable beds and rafts are also commonly used and require substantial effort to inflate. The air/gas supply system provided herein also allows these devices to be quickly and conveniently inflated.

As can be seen, the air/gas supply system is not limited to tools, and can be effectively used with any device that requires high pressure air. For ease of discussion, the air/gas supply system disclosed herein used devices such as pneumatic tools to describe the benefits of the invention. However, it is understood that any device which uses air pressure (e.g., tools, tires, recreational equipment such as tents, rafts, and beds, etc.) can also benefit form the invention. We turn now to a more detailed discussion of the figures.

Referring to FIG. 1, this figure illustrates a preferred embodiment of the invention in which the pneumatic air supply system is suspended from a workman's 1 back. It includes a high pressure air/gas supply vessel 2 which contains a supply of pressurized air/gas which is used to power a variety of tools 5 or other devices. In the preferred embodiment, the air/gas supply vessel 2 is fabricated from a small or large lightweight carbon fiber vessel. The advantage of this type of vessel is that it combines very light weight with a high level of strength such that it can hold compressed gases at pressure ratings up to approximately 6,000 psi. Due to this high pressure rating, a substantial amount of compressed air/gas is available for use by the workman's tool 5. Those skilled in the art will recognize that while carbon fiber is used to fabricate the air/gas supply vessel 2 in the preferred embodiment, it can be fabricated by any material which is suitable for the purpose of carrying high pressure air/gas in a small or large lightweight container.

In this embodiment, the air/gas in the air/gas supply vessel 2 is output via an adjustable pressure control valve 3 to the proximal end of a high pressure air hose 4. High pressure air hoses 4 are well-known in the art and are commercially available from a variety of sources. The distal end of the high pressure air hose 4 is attached to an input 9 on the tool 5. The adjustable pressure control valve 3 is set by the workman 1 to the appropriate pneumatic pressure level for the particular tool 5. The typical value for handheld pneumatic power tools would be in the general range of approximately 125 psi or less, which is substantially less than the 3,000–6,000 psi range envisioned for the air/gas supply vessel 2. Of course, the pressure used by each tool 5 will vary depending on the particular task the tool 5 is intended to perform.

The input 9 is preferably a universal adapter which is found on most commercially available tools 5. The advantage of using a universal adapter in conjunction with the air/gas pneumatic air supply system is that it allows the air/gas pneumatic air supply system to be used with virtually any air powered tool 5. This eliminates the need for any redundant parts, and it provides a significant convenience to the workman 1 because the workman 1 needs only to quickly disconnect the high pressure air hose 4 from the tool 5 and then connect it to the next necessary tool. As a result, the workman 1 is able to carry the small or large lightweight air/gas supply system which is conveniently secured to the workman's 1 tool belt, and which is always available whenever the workman needs it.

In this alternative preferred embodiment, the air/gas supply vessel 2 is secured via a strap 7 to back brace 6. In turn, back brace 6 is secured to the workman 1 via straps 8. Those skilled in the art will recognize that the back brace illustrated in this figure is for illustrative purposes only, and any suitable method of securing the air/gas supply vessel 2 to the workman 1 can be used. For example, the back brace 6 and the straps 8 can be replaced with a conventional back support brace which is often use by workman who engage in lifting heavy objects. In this embodiment, strap 7 would be attached to the conventional back support by any suitable means, such as hook and loop material, buckles, etc. As a result, the workman 1 would not be required to carry any additional material other than the strap 7, the air/gas supply vessel 2, the regulator 3, and the high pressure air hose 4.

Figure 2:
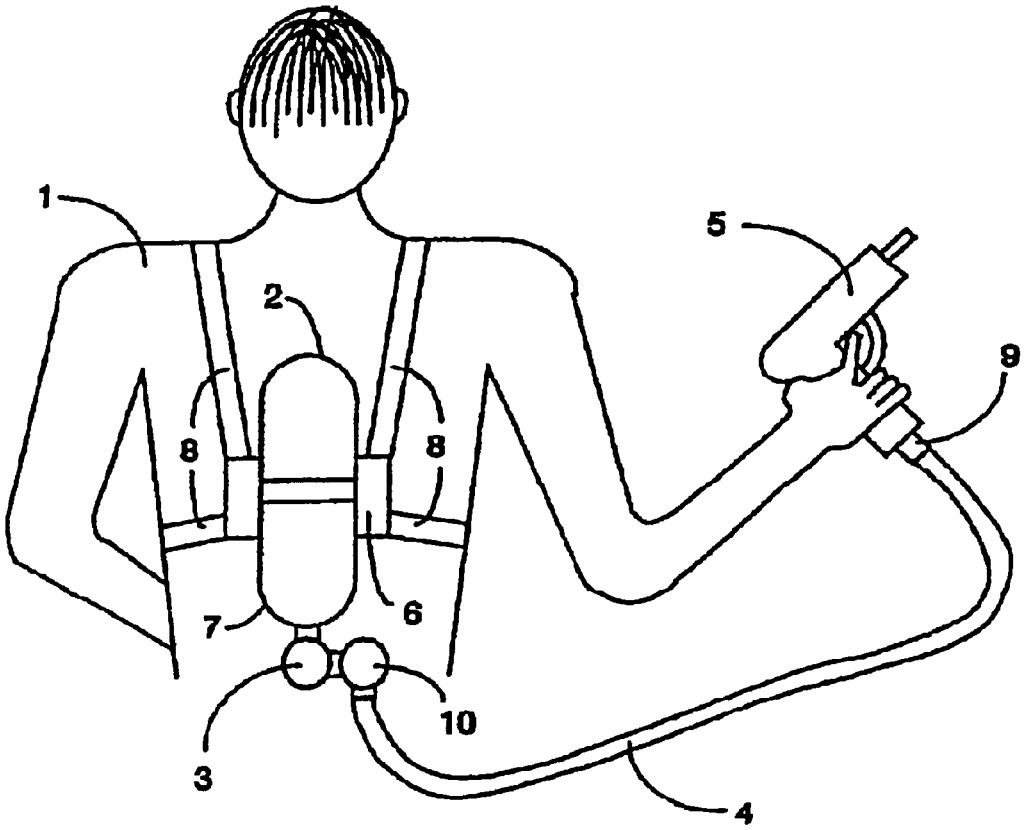
FIG. 2 illustrates an alternative preferred embodiment of the pneumatic air/gas supply system in which the first high pressure regulation valve outputs air/gas pressure at an intermediate range to a second low pressure adjustable regulation valve which in turn outputs air/gas at selectable low pressure ratings.

In FIG. 2, another alternative preferred embodiment of the pneumatic air/gas supply system is illustrated. In this embodiment, a high pressure regulation valve 3 is attached to the air/gas supply vessel 2. The air/gas is output from the air/gas supply vessel 2 with a supply of approximately 4,500 psi to the high pressure regulation valve 3 approximately 1,000 psi. The output of the high pressure regulation valve 3 is fed directly to the low pressure regulation valve 10 at an intermediate pressure range (for example: 0–1000 psi range). The low pressure regulation valve 10 then outputs air/gas pressure at to a second low pressure adjustable regulation valve which in turn outputs air/gas at selectable low pressure ratings, typically in the range of approximately 125 psi or lower. The overall process is similar to that described in regard to FIG. 1, with the exception that a wider range of commercially available off-the-shelf valves 3 and 10 can be used which may substantially reduce fabrication costs that would otherwise be higher due to the costs associated with a single high pressure valve 3 capable of outputting relatively low pressure air/gas.

For ease of discussion, the foregoing values were used to describe the various elements of the invention. However, those skilled in the art will recognize that the high, intermediate, and low pressure ratings used in the foregoing example can in practice vary widely over a substantial range.

Figure 3:
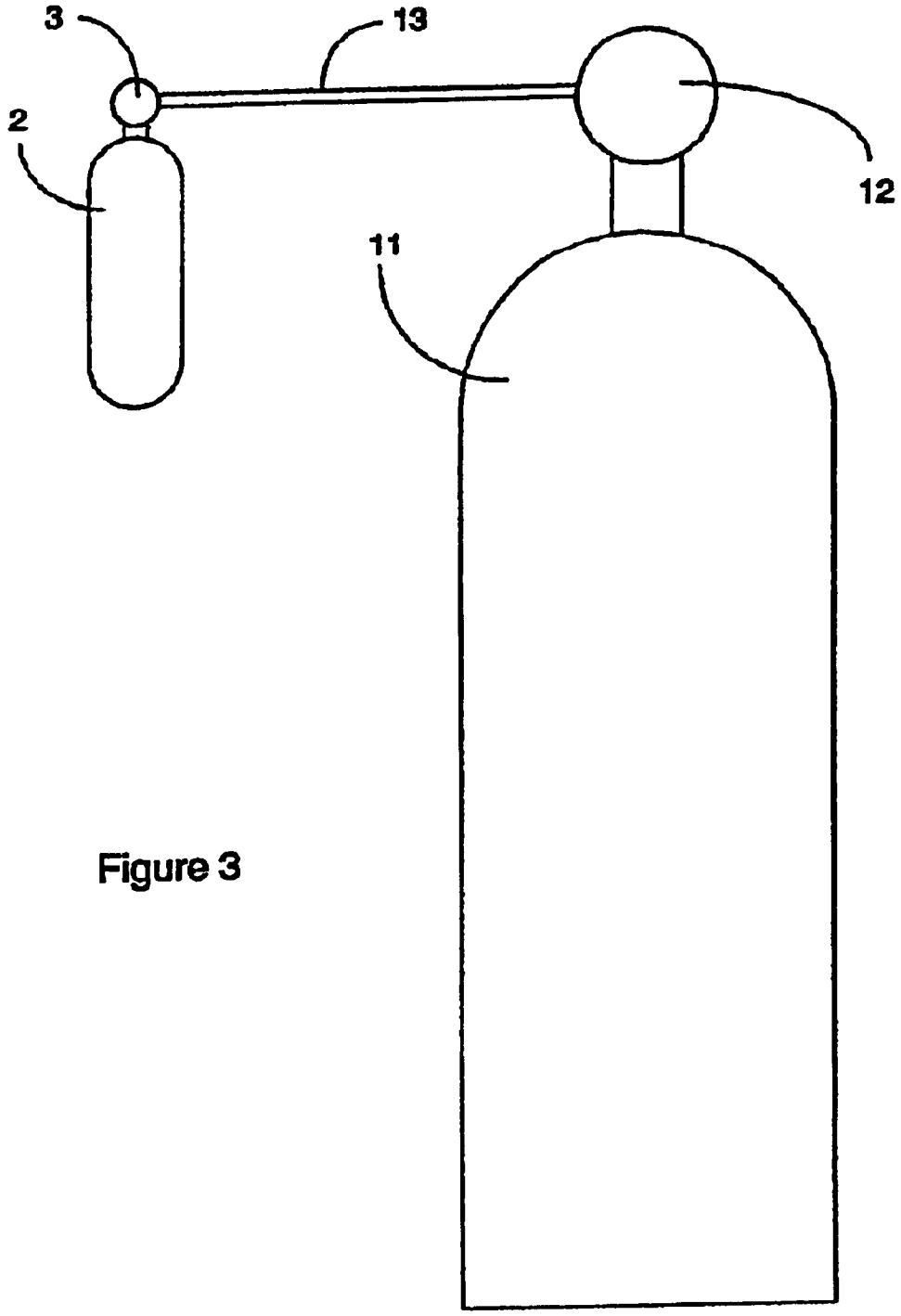
FIG. 3 illustrates another preferred embodiment which uses a reservoir tank as a replenishment source for the air/gas supply vessel.

FIG. 3 illustrates an alternative embodiment in which a reservoir tank 11 is used to replenish the air/gas supply vessel 2. For most applications, the air/gas supply vessel 2 is capable of supplying a tool 5 with adequate pneumatic power to enable it to be used for the entire workday. However, depending on the nature of the tool 5 being used, and the type of work being done, it is possible that the air/gas supply vessel 2 may be depleted. While it is always possible to carry additional air/gas supply vessels 2 to replace a depleted air/gas supply vessel 2, the optional reservoir tank 11 which is used in this embodiment provides several advantages.

First, the reservoir tank 11 is substantially larger than the air/gas supply vessel 2 and has a substantially larger supply of compressed air/gas. As a result, this single reservoir tank 11 can provide a supply of compressed air/gas which is equivalent to many additional air/gas supply vessels 2. In addition, in a work site where many workmen 1 are using a variety of tools 5, a single reservoir tank 11 can be shared by many workmen 1. This is less expensive and more convenient than having to provide for numerous extra air/gas supply vessels 2. In addition, the reservoir tank 11 can be implemented in a variety of ways. It can be fabricated from a large carbon fiber tank, or as mentioned above, it can even be implemented in the form of a conventional aluminum or steel scuba tank of any size. Even though it is substantially larger than an air/gas supply vessel 2, a reservoir tank 11 can be easily moved when needed, and can be stored in a convenient location such as the back of the workman's 1 truck, or even in the truck of the workman's 1 car.

During the replenishment process, high pressure air/gas is output from a quick disconnect adapter 16 which is attached to the reservoir tank 11. The air/gas output by the reservoir tank 11 travels through the air hose 13 to the high pressure valve 3 on the air/gas supply vessel 2. Once the air/gas supply vessel 2 has been replenished with the high pressure air/gas input from the reservoir tank 11, the air hose 13 is disconnected and the air/gas supply vessel 2 is again ready for use. This process is very rapid and allows a workman to quickly refill the air/gas supply vessel 2 with a minimal amount of disruption to work or wasted time. Those skilled in the art will recognize that while separate valves can be used to refill the air/gas supply vessel 2, using the high pressure valve 3 is simpler and easier to use. The use of valves to control refilling of vessels is well-known in the art.

Figure 4:
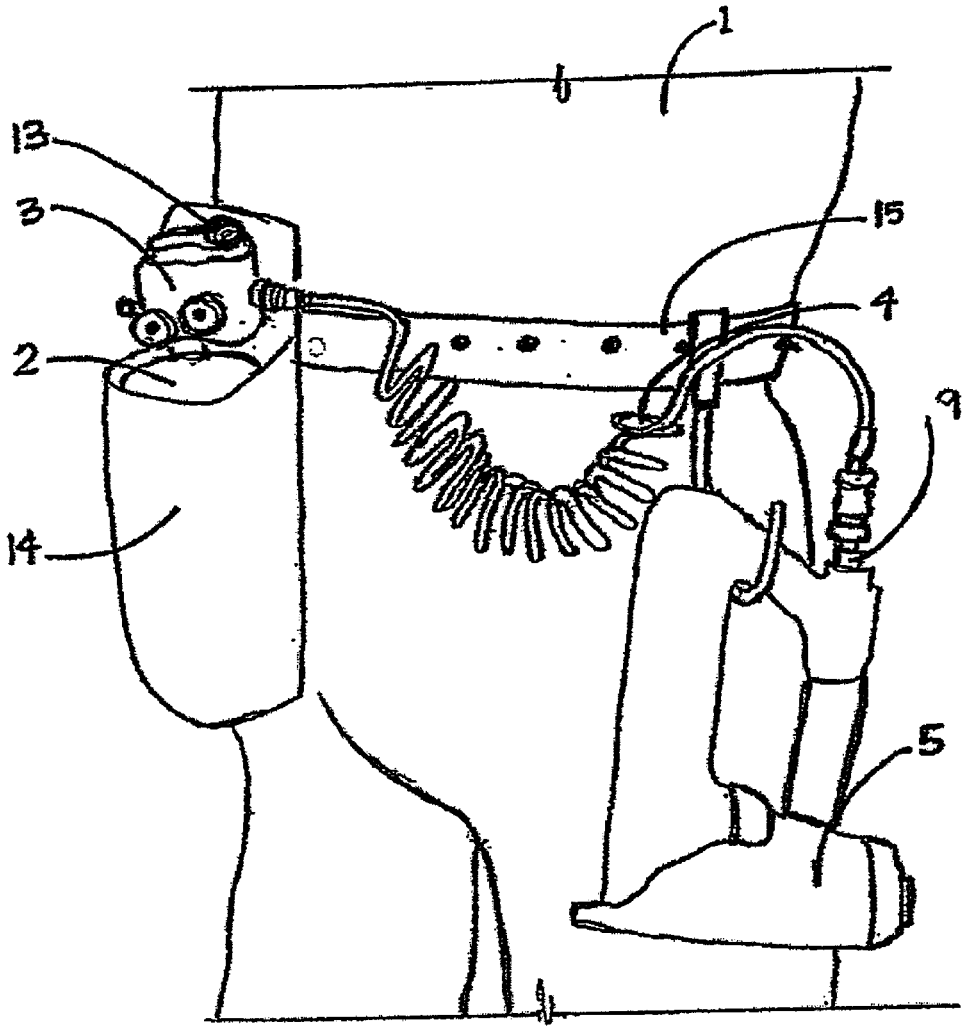
FIG. 4 illustrates an alternative preferred embodiment of the pneumatic air/gas supply system in which the air/gas supply vessel is secured to the tool belt of a workman.

In FIG. 4, an alternative preferred embodiment of the pneumatic air/gas supply system is illustrated. In this embodiment, the air/gas supply vessel 2 is secured to a workman's 1 tool belt 15 by a sleeve 14. Also shown in this figure is a shutoff valve 13 which, when closed, allows the high pressure air hose 4 and pressure valve 3 to be safely detached. Air hose 4 is also shown attached to tool 5 at input 9.

Figure 5:
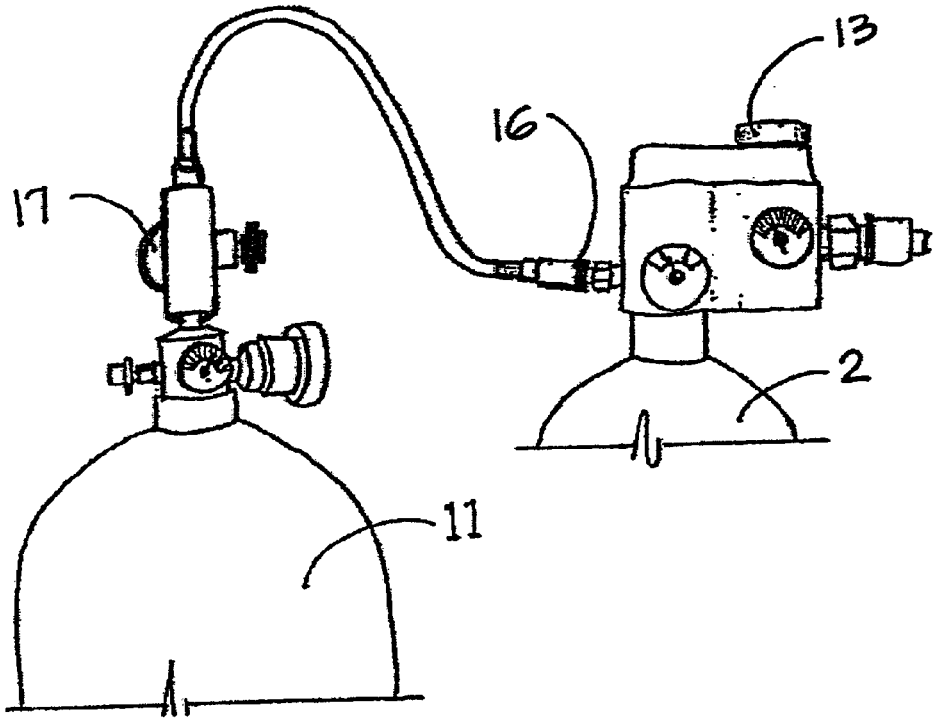
FIG. 5 illustrates an air/supply vessel attached to a reservoir tank.

FIG. 5 is a preferred embodiment which illustrates an air/gas supply vessel 2 in the process of being refilled by a reservoir tank 11. In this embodiment, the air/gas supply vessel 2 is attached to the reservoir tank 11 via a quick disconnect adapter 16 which is attached to the reservoir tank 11. Prior to attachment, the shutoff valves 13, 17 on the air/gas supply vessel 2 and the reservoir tank 11 are closed. Once the reservoir tank 11 and the air/gas supply vessel 2 are attached via the quick disconnect adapter 16, the shutoff valve 17 is opened and high pressure air or gas from the reservoir tank refills the air/gas supply vessel 2. When the air/gas supply vessel 2 is refilled, then the shutoff valve 17 is closed and the air/gas supply vessel 2 is disconnected from the reservoir tank 11. As can be seen, the refilling process is fast and easy due to the quick disconnect adapter 16. Adapter assemblies are well known in the art.

Figure 6:
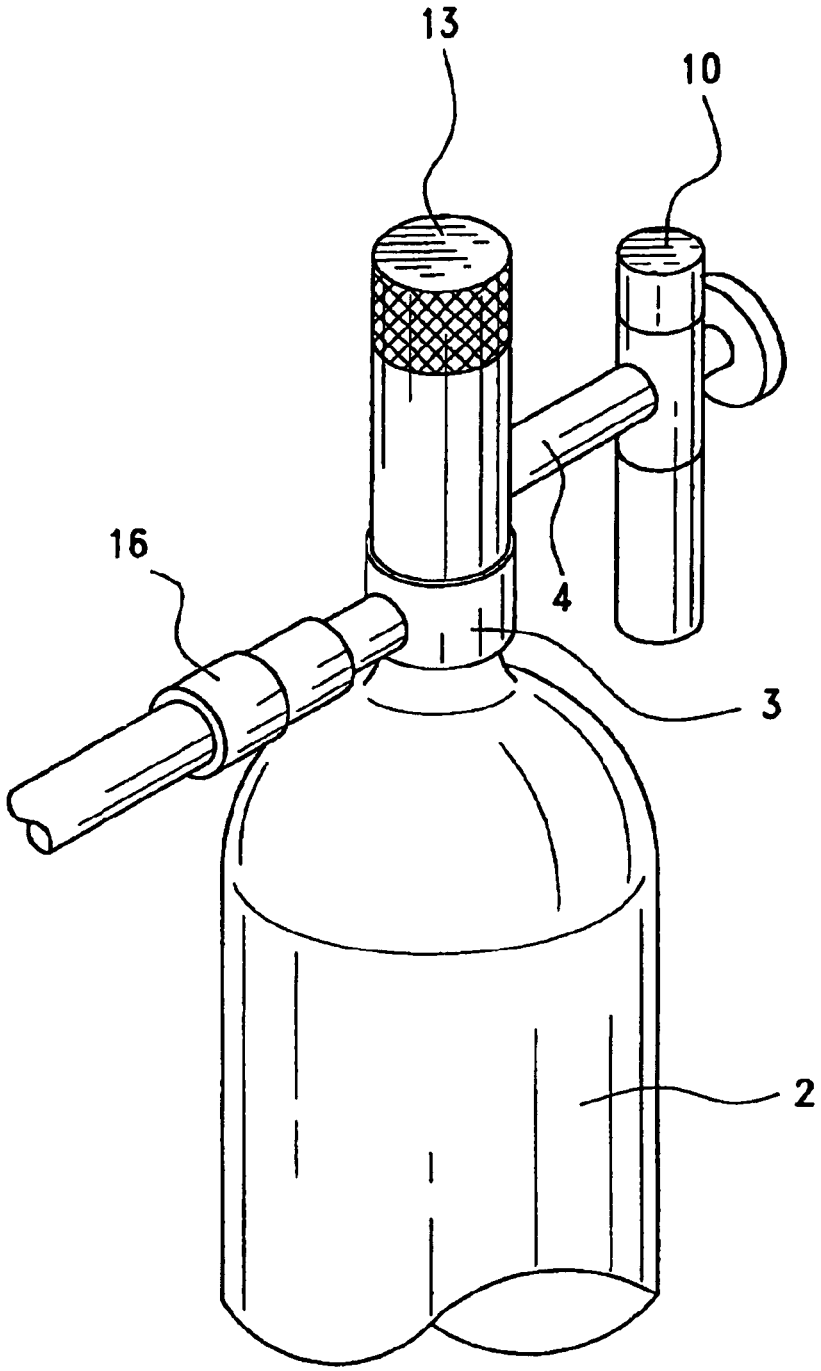
FIG. 6 illustrates an alternative embodiment which shows an air/supply vessel attached to a reservoir tank via an adapter. Two pressure reduction valves are also shown serially attached to the output of the air/gas supply vessel.

In FIG. 6, the air/supply vessel 2 attached to a reservoir tank 11 via an adapter 16. Two pressure valves 3 and 10 are also shown serially attached to the output of the air/gas supply vessel. The air hose 4 is shown attached to the output of the second valve 10.

While the invention has been described with respect to a preferred embodiment thereof, it will be understood by those skilled in the art that various changes in detail may be made therein without departing from the spirit, scope, and teaching of the invention. For example, the material used to fabricate the portable air/gas supply vessel may be anything suitable for its purpose, the size and shape of the portable air/gas supply vessel may vary. The type of gaseous material stored in the air/gas supply vessel can be any suitable material. Accordingly, the invention herein disclosed is to be limited only as specified in the following claims.

I claim:

1. A tailorable, man-portable, pneumatic tool power supply system comprising:

a man-portable air/gas reservoir containing air/gas compressed to a high initial pressure;

a pressure regulator in air/gas flow communication with said man-portable air/gas reservoir, said pressure regulator including an air/gas pressure adjustment mechanism capable of adjusting pressure of air/gas outflow therefrom, said pressure regulator being so connected to said man-portable air/gas reservoir such that compressed air/gas which exits said man-portable air/gas reservoir is delivered to said pressure regulator;

an interconnect attached to and providing air/gas flow communication between said pressure regulator and an air/gas outlet; said air/gas outlet including a coupler mechanism for connecting said air/gas outlet to a pneumatically operable tool; said interconnect comprising a flexible conduit having a quick connect-disconnect coupler attached proximal one end thereof for connecting and disconnecting to a pneumatically operable tool;

wherein said air/gas pressure adjustment mechanism is capable of operating to deliver a plurality of selected air/gas pressures which correspond to pressures useful for operating a plurality of pneumatically operable tools;

wherein said pressure regulator is capable of receiving said compressed air/gas and thereafter delivering said air/gas to said interconnect at a reduced pressure relative to said high initial pressure as contained in said man-portable air/gas reservoir; and wherein said pressure regulator is a dual stage regulator and said air/gas flow output pressure is regulated by said pressure regulator in a dual stage regulation comprising:

receiving air/gas flow at said high initial pressure;

reducing said high initial pressure of said air/gas flow to an intermediate pressure at a first stage;

reducing said intermediate pressure of said air/gas flow to a working pressure at a second stage, said working pressure being selected from within a range of pressures suitable for operating a plurality of pneumatically operable tools.

2. The system according to claim 1 wherein said working pressure is selected from between approximately a value greater than 0 and a value equal to or less than 125 psi.

3. The system according to claim 1 further including:

a plurality of pneumatically operable tools having universal connectors; and wherein said quick connect-disconnect coupler of said conduit is capable of being selectively, alternately connected to said plurality of pneumatically operable tools such that, when connected, said tools are in air/gas flow communication with said pressure regulator via said conduit.

4. The system according to claim 3 wherein said system is so configured so as to be capable of providing a workable output pressure to operate a plurality of pneumatic tools, including at least: a nail gun, an air wrench, a paint sprayer, an inflator, a stapler, a micro pinner, a pin tacker, and a drill.

5. The system according to claim 1 wherein said pressure regulator further includes an air/gas flow input which is so constructed so as to be capable of being communicably connected to a air/gas storage reservoir so that said air/gas storage reservoir can replenish air/gas pressure to said man-portable air/gas reservoir.

6. The system according to claim 1 wherein said pressure regulator further includes an air/gas flow input which is so constructed so as to be capable of being communicably connected to a high pressure compressor so that said high pressure compressor can replenish air/gas pressure to said man-portable gas reservoir.

7. The system according to claim 1 further including a valve communicably connected to said man-portable air/gas reservoir at a valve input and communicably connected to said pressure regulator, said valve being so constructed so as to be capable of delivering air/gas from said man-portable air/gas reservoir to said pressure regulator.

8. The system according to claim 5 wherein said air/gas storage reservoir comprises a supply vessel having a quick connect-disconnect coupler for communicably connecting to said air/gas flow input.

9. The system according to claim 5 wherein said man-portable air/gas reservoir has a rated pressure of at least 5000 psi and weighs less than approximately 30 lbs.

10. The system according to claim 5 wherein said man-portable air/gas reservoir is constructed, at least in part, from a material selected from the group consisting of: steel, aluminum, and carbon fiber.

11. A tailorable, man-portable, pneumatic tool power supply system comprising:

a man-portable air/gas reservoir;

a pressure regulator in air/gas flow communication with said man-portable air/gas reservoir, said pressure regulator including an air/gas pressure adjustment mechanism capable of adjusting pressure of air/gas outflow therefrom;

an interconnect attached to and providing air/gas flow communication between said pressure regulator and an air/gas outlet, said air/gas outlet including a coupler mechanism for connecting said air/gas outlet to a pneumatically operable tool; and wherein said air/gas pressure adjustment mechanism is capable of operating to deliver a plurality of selected air/gas pressures which correspond to pressures useful for operating a plurality of pneumatic tools; and wherein said man-portable air/gas reservoir has a rated pressure of at least 3000 psi and weighs less than approximately 10 lbs.

12. The system according to claim 7 wherein said man-portable air/gas reservoir has a rated pressure of at least 5000 psi and weighs less than 50 lbs.

13. The system according to claim 1 wherein said man-portable air/gas reservoir is configured to be attached to a user-wearable belt.

14. The system according to claim 1 wherein said man-portable air/gas reservoir is configured to be attached to a user-wearable back harness.

15. The system according to claim 5 further including a valve for allowing or preventing air/gas flow from said man-portable air/gas reservoir.

16. The system according to claim 1 wherein said intermediate pressure is selected from between approximately 800–4500 psi and said working pressure is less than or equal to approximately 125 psi.

17. A tailorable, man-portable, pneumatic tool power supply system comprising:

a man-portable air/gas reservoir containing air/gas compressed to a high initial pressure;

a pressure regulator in air/gas flow communication with said man-portable air/gas reservoir, said pressure regulator including an air/gas pressure adjustment mechanism capable of adjusting pressure of air/gas outflow therefrom, said pressure regulator being so connected to said man-portable air/gas reservoir such that compressed air/gas which exits said man-portable air/gas reservoir is delivered to said pressure regulator;

an interconnect attached to and providing air/gas flow communication between said pressure regulator and an air/gas outlet; said air/gas outlet including a coupler mechanism for connecting said air/gas outlet to a pneumatically operable tool; said interconnect comprising a flexible conduit having a quick connect-disconnect coupler attached proximal one end thereof for connecting and disconnecting to a pneumatically operable tool;

wherein said air/gas pressure adjustment mechanism is capable of operating to deliver a plurality of selected air/gas pressures which correspond to pressures useful for operating a plurality of pneumatically operable tools;

wherein said pressure regulator is capable of receiving said compressed air/gas and thereafter delivering said air/gas to said interconnect at a reduced pressure relative to said high initial pressure as contained in said man-portable air/gas reservoir;

wherein said pressure regulator is so constructed such that said air/gas flow output pressure is regulated by said pressure regulator in a single stage regulation step comprising:

receiving air/gas flow at said high initial pressure and thereafter delivering said air/gas flow at reduced pressures relative to said initial high pressure, said reduced pressures being selectable from within a range of air/gas pressures suitable for operating a plurality of pneumatic tools; and wherein said pressure regulator further includes an air/gas flow input which is so constructed so as to be capable of being communicably connected to a high pressure compressor so that said high pressure compressor can replenish gas pressure to said man-portable gas reservoir.

18. A tailorable, man-portable, pneumatic tool power supply system comprising:

a man-portable air/gas reservoir containing air/gas compressed to a high initial pressure;

a pressure regulator in air/gas flow communication with said man-portable air/gas reservoir, said pressure regulator including an air/gas pressure adjustment mechanism capable of adjusting pressure of air/gas outflow therefrom, said pressure regulator being so connected to said man-portable air/gas reservoir such that compressed air/gas which exits said man-portable air/gas reservoir is delivered to said pressure regulator;

an interconnect attached to and providing air/gas flow communication between said pressure regulator and an air/gas outlet; said air/gas outlet including a coupler mechanism for connecting said air/gas outlet to a pneumatically operable tool; said interconnect comprising a flexible conduit having a quick connect-disconnect coupler attached proximal one end thereof for connecting and disconnecting to a pneumatically operable tool;

wherein said air/gas pressure adjustment mechanism is capable of operating to deliver a plurality of selected air/gas pressures which correspond to pressures useful for operating a plurality of pneumatically operable tools;

wherein said pressure regulator is capable of receiving said compressed air/gas and thereafter delivering said air/gas to said interconnect at a reduced pressure relative to said high initial pressure as contained in said man-portable air/gas reservoir;

wherein said pressure regulator is so constructed such that said air/gas flow output pressure is regulated by said pressure regulator in a single stage regulation step comprising:

receiving air/gas flow at said high initial pressure and thereafter delivering said air/gas flow at reduced pressures relative to said initial high pressure, said reduced pressures being selectable from within a range of air/gas pressures suitable for operating a plurality of pneumatic tools; and further including a valve communicably connected to said man-portable air/gas reservoir at a valve input and communicably connected to said pressure regulator, said valve being so constructed so as to be capable of delivering air/gas from said man-portable air/gas reservoir to said pressure regulator.

19. A tailorable, man-portable, pneumatic tool power supply system comprising:

a man-portable air/gas reservoir containing air/gas compressed to a high initial pressure;

a pressure regulator in air/gas flow communication with said man-portable air/gas reservoir, said pressure regulator including an air/gas pressure adjustment mechanism capable of adjusting pressure of air/gas outflow therefrom, said pressure regulator being so connected to said man-portable air/gas reservoir such that compressed air/gas which exits said man-portable air/gas reservoir is delivered to said pressure regulator;

an interconnect attached to and providing air/gas flow communication between said pressure regulator and an air/gas outlet; said air/gas outlet including a coupler mechanism for connecting said air/gas outlet to a pneumatically operable tool; said interconnect comprising a flexible conduit having a quick connect-disconnect coupler attached proximal one end thereof for connecting and disconnecting to a pneumatically operable tool;

wherein said air/gas pressure adjustment mechanism is capable of operating to deliver a plurality of selected air/gas pressures which correspond to pressures useful for operating a plurality of pneumatically operable tools;

wherein said pressure regulator is capable of receiving said compressed air/gas and thereafter delivering said air/gas to said interconnect at a reduced pressure relative to said high initial pressure as contained in said man-portable air/gas reservoir;

wherein said pressure regulator is so constructed such that said air/gas flow output pressure is regulated by said pressure regulator in a single stage regulation step comprising:

receiving air/gas flow at said high initial pressure and thereafter delivering said air/gas flow at reduced pressures relative to said initial high pressure, said reduced pressures being selectable from within a range of air/gas pressures suitable for operating a plurality of pneumatic tools;

wherein said pressure regulator further includes an air/gas flow input which is so constructed so as to be capable of being communicably connected to an air/gas storage reservoir so that said air/gas storage reservoir can replenish air/gas pressure to said man-portable air/gas reservoir; and wherein said air/gas storage reservoir comprises a supply vessel having a quick connect-disconnect coupler for communicably connecting to said air/gas flow input.

20. A tailorable, man-portable, pneumatic tool power supply system comprising:

a man-portable air/gas reservoir containing air/gas compressed to a high initial pressure;

a pressure regulator in air/gas flow communication with said man-portable air/gas reservoir, said pressure regulator including an air/gas pressure adjustment mechanism capable of adjusting pressure of air/gas outflow therefrom, said pressure regulator being so connected to said man-portable air/gas reservoir such that compressed air/gas which exits said man-portable air/gas reservoir is delivered to said pressure regulator;

an interconnect attached to and providing air/gas flow communication between said pressure regulator and an air/gas outlet; said air/gas outlet including a coupler mechanism for connecting said air/gas outlet to a pneumatically operable tool; said interconnect comprising a flexible conduit having a quick connect-disconnect coupler attached proximal one end thereof for connecting and disconnecting to a pneumatically tool;

wherein said air/gas pressure adjustment mechanism is capable of operating to deliver a plurality of selected air/gas pressures which correspond to pressures useful for operating a plurality of pneumatically operable tools;

wherein said pressure regulator is capable of receiving said compressed air/gas and thereafter delivering said air/gas to said interconnect at a reduced pressure relative to said high initial pressure as contained in said man-portable air/gas reservoir;

wherein said pressure regulator is so constructed such that said air/gas flow output pressure is regulated by said pressure regulator in a single stage regulation step comprising:

receiving air/gas flow at said high initial pressure and thereafter delivering said air/gas flow at reduced pressures relative to said initial high pressure, said reduced pressures being selectable from within a range of air/gas pressures suitable for operating a plurality of pneumatic tools;

wherein said pressure regulator further includes an air/gas flow input which is so constructed so as to be capable of being communicably connected to an air/gas storage reservoir so that said air/gas storage reservoir can replenish air/gas pressure to said man-portable air/gas reservoir; and wherein said man-portable air/gas reservoir has a rated pressure of at least 5000 psi and weighs less than approximately 30 lbs.

21. The system according to claim 18 wherein said man-portable air/gas reservoir has a rated pressure of at least 5000 psi and weighs less than 50 lbs.

* * * * *